US009335690B2

(12) United States Patent
Asaka et al.

(10) Patent No.: US 9,335,690 B2
(45) Date of Patent: May 10, 2016

(54) PRESSING ROLLER AND IMAGE HEATING APPARATUS HAVING SAME

(71) Applicant: CANON KABUSHIKI KAISHA, Tokyo (JP)

(72) Inventors: Akeshi Asaka, Kashiwa (JP); Shuichi Tamura, Moriya (JP); Daigo Matsuura, Toride (JP); Shigeaki Takada, Abiko (JP); Naoki Akiyama, Toride (JP); Yasuhiro Miyahara, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/562,997

(22) Filed: Dec. 8, 2014

(65) Prior Publication Data

US 2015/0160596 A1 Jun. 11, 2015

(30) Foreign Application Priority Data

Dec. 9, 2013 (JP) ..... 2013-254131

(51) Int. Cl.
*G03G 15/20* (2006.01)

(52) U.S. Cl.
CPC ..... *G03G 15/206* (2013.01)

(58) Field of Classification Search
CPC ..... G03G 15/206; G03G 15/2089
See application file for complete search history.

(56) References Cited

U.S. PATENT DOCUMENTS

| | | | |
|---|---|---|---|
| 8,688,023 | B2 | 4/2014 | Sekihara et al. |
| 2011/0082260 | A1 | 4/2011 | Omata et al. |
| 2014/0112692 | A1 | 4/2014 | Omata et al. |
| 2014/0248071 | A1 | 9/2014 | Matsunaka et al. |

FOREIGN PATENT DOCUMENTS

| | | | |
|---|---|---|---|
| JP | 2002-0351243 | A | 12/2002 |
| JP | 2012-37874 | A | 2/2012 |

*Primary Examiner* — Erika J Villaluna

(74) *Attorney, Agent, or Firm* — Fitzpatrick, Cella, Harper & Scinto

(57) ABSTRACT

A pressing roller includes a cylindrical core metal; a first rubber layer of non-porous material provided on the core metal; and a second rubber layer of porous material provided on the first rubber layer, wherein the second rubber layer includes a thermo-conductive filler dispersed therein such that a thermal conductivity of the second rubber layer in a longitudinal direction is higher than a thermal conductivity thereof in a thickness direction, and wherein the first rubber layer includes a thermo-conductive filler dispersed therein such that a thermal conductivity of the first rubber layer in an thickness direction is higher than a thermal conductivity of the second rubber layer in the thickness direction of the second rubber layer.

20 Claims, 3 Drawing Sheets

(a)

(b)

PRESSING ROLLER AND IMAGE HEATING APPARATUS HAVING SAME

FIELD OF THE INVENTION AND RELATED ART

The present invention relates to a pressure roller, and an image heating apparatus having a pressure roller. A pressure roller, and an image heating apparatus having a pressure roller, are employed by an image forming apparatus such as a copying machine, a printer, a facsimile machine, and a multifunction machine capable of performing the function of two or more of the preceding apparatuses.

In the field of an image forming apparatus, it has been common practice to form a toner image on a sheet of recording paper (recording medium), and apply heat and pressure to the sheet, and the toner image thereon, with the use of a fixing apparatus (image heating apparatus) to fix the toner image to the sheet. A fixing apparatus (device) such as the one described above has a pair of rotational members. It forms a nip for fixing the toner image, by the pair of rotational members. Generally speaking, one of the rotational members is a pressure roller.

In a case where a substantial number of sheets of recording paper (which hereafter may be referred to simply as sheet of small size), which are less in width than the widest sheet of recording medium which is processible by a fixing apparatus (device), are continuously conveyed, for fixation, through the fixing apparatus, the portions of each of the pair of rotational members, which do not come into contact with the sheets of recording paper, excessively increase in temperature (this phenomenon may be referred to simply as out-of-sheet-path temperature increase).

Thus, in the case of the apparatuses disclosed in Japanese Laid-open Patent Applications 2002-0351243, and 2012-37874, thermally conductive filler is dispersed in the rubber layer of its pressure roller to improve the pressure roller in the thermal conduction in its lengthwise direction.

Further, in the case of the apparatus disclosed in Japanese Laid-open Patent Application 2012-37874, the rubber layer of its pressure roller is formed of porous rubber to thermally insulate the metallic core of the pressure roller to prevent the heat from a heat source, from being robbed by the metallic core.

However, in a case where the metallic core of a pressure roller is thermally insulated as described above, it is possible to minimize the out-of-sheet-path portion temperature increase phenomenon which occurs as a substantial number of small sheets of recording paper are continuously processed by a fixing apparatus. However, it is difficult for the heat in the rubber layer to escape.

SUMMARY OF THE INVENTION

According to an aspect of the present invention, there is provided a pressing roller comprising a cylindrical core metal; a first rubber layer of non-porous material provided on said core metal; and a second rubber layer of porous material provided on said first rubber layer, wherein said second rubber layer includes a thermo-conductive filler dispersed therein such that a thermal conductivity of said second rubber layer in a longitudinal direction is higher than a thermal conductivity thereof in a thickness direction, and wherein said first rubber layer includes a thermo-conductive filler dispersed therein such that a thermal conductivity of said first rubber layer in an thickness direction is higher than a thermal conductivity of said second rubber layer in the thickness direction of said second rubber layer.

According to another aspect of the present invention, there is provided an image heating apparatus comprising (i) a rotatable heating member configured to heat a toner image on a recording material by a nip; and (ii) a pressing rotatable member cooperative with said rotatable heating member to form the nip, said pressing rotatable member including, (ii-i) a base, (ii-ii) a first rubber layer of non-porous material provided on said base, and (ii-iii) a second rubber layer of porous material provided on said first rubber layer, wherein said second rubber layer includes a thermo-conductive filler dispersed therein such that a thermal conductivity of said second rubber layer in a longitudinal direction is higher than a thermal conductivity thereof in a thickness direction, and wherein said first rubber layer includes a thermo-conductive filler dispersed therein such that a thermal conductivity of said first rubber layer in an thickness direction is higher than a thermal conductivity of said second rubber layer in the thickness direction of said second rubber layer.

Further features of the present invention will become apparent from the following description of exemplary embodiments (with reference to the attached drawings).

DESCRIPTION OF THE PREFERRED EMBODIMENTS

Figure 1:
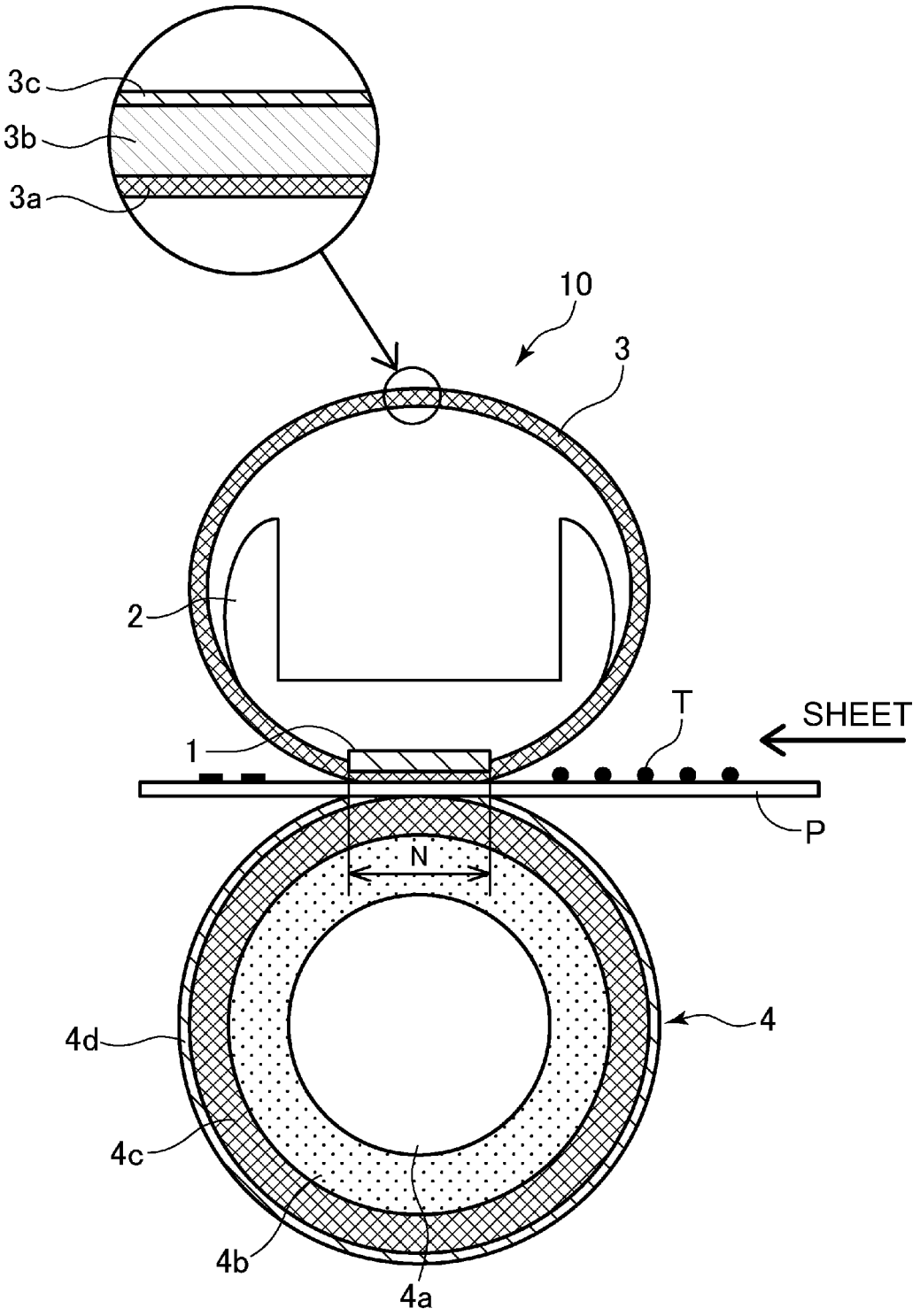
FIG. 1 is a schematic sectional view of a typical fixing apparatus (device), and shows the structure of the apparatus.

Hereinafter, some of the embodiments of the present invention are described in detail with reference to appended drawings. To begin with, referring to FIG. 1, a fixing device 10 which is an image heating apparatus in accordance with the present invention is described. FIG. 1 is a schematic sectional view of the fixing device 10. It shows the general structure of the device 10.

[Fixing Device]

The fixing device 10 shown in FIG. 1 has: a heater 1 as a heating member; a heater holder 2 as a heating member supporting member; a fixation belt (rotational heating member) 3; and a pressure roller (pressure applying rotational member) 4. The heater 1 is a heat source made up of a heat generating resistor, for example, which generates heat as electrical current is flowed through it by an unshown means. It is controlled so that its temperature remains at a preset level. The heater 1 is fixed to a heater holder 2 (which hereafter may be referred to simply as holder) which is rigid. More specifically, the holder 2 is formed of a heat resistant substance. It is in the form of a trough which is roughly semicircular in cross section. More concretely, the downwardly facing surface of the holder 2 is provided with a groove which extends in the lengthwise direction of the holder (direction perpendicular to sheet on which FIG. 1 is drawn). It is in this groove that the heater 2 is fitted.

The fixation belt 3 is circular. It has three layers, more specifically, a substrative layer 3*a*, an elastic layer 3*b* (which hereafter will be referred to as belt's elastic layer to be differentiated from elastic layer of pressure roller, which will be described later), and a surface layer 3*c*, listing from the inward side of the belt 3. The fixation belt 3 is an endless belt.

Its inward surface is rubbed by the heater 1 and holder while an image is formed. It is loosely fitted around the holder 2, and the heater 1 held by the holder 2. It is rotated by the rotation of the pressure roller 4, which will be described later). It is rotatably supported by stationary component, such as a frame, of the fixing device 10, by its lengthwise ends. The inward surface of the fixation belt 3 is coated with lubricant to ensure that the fixation belt 3 smoothly slides on the heater 1 and holder 2. Incidentally, a component which is referred to as "belt" in this specification includes such fixation belts that are not endless.

The pressure roller 4 has: a cylindrical substrate 4*a*; elastic layers (4*b* and 4*c*) made of rubber; and a parting layer 4*d*, listing from the inward side of the roller 4. It is rotationally driven by a rotational driving apparatus (unshown), such as a motor, while an image is formed. Thus, it is rotatably supported by an unshown stationary component, for example, frame of the fixing device 10, by the lengthwise ends of its substrate 4*a* in terms of its axial direction. Further, the pressure roller 4 is disposed so that it opposes the heater 1 supported by the holder 2, with the presence of the fixation belt 3 between itself and heater 1. Thus, as a preset amount of pressure is applied to the pressure roller 4 and fixation belt 3 by a pressure application mechanism (unshown), the pressure roller 4 and fixation belt 3 are made to press against each other, causing thereby their elastic layers (3*b*, 4*b*, and 4*c*) to elastically deform. Consequently, a fixation nip N, which has a preset width in terms of the recording paper conveyance direction, is formed between the pressure roller 4 and fixation belt 3.

As the pressure roller 4 is rotationally driven by a rotational driving apparatus (unshown), a sheet P of recording paper (recording medium) is conveyed through the fixation nip N, remaining pinched by the pressure roller 4, and fixation belt 3 which is being moved by the rotation of the pressure roller 4. The fixation belt 3 is heated until its surface temperature reaches a preset level (200° C., for example). As a sheet P of recording paper, on which an unfixed toner image formed of toner T is present, is conveyed through the fixation nip N, remaining pinched by the pressure roller 4 and fixation belt 3, while the surface temperature of the fixation belt 3 is kept at the preset level, the unfixed toner T on the sheet P is subjected to heat and pressure. Thus, the unfixed toner T melts and mixes. Consequently, the unfixed toner image becomes fixed to the sheet P as it cools down along with the sheet P.

[Fixation Belt]

Next, the fixation belt 3 is described. Referring to FIG. 1, the fixation belt 3 has: the substrate 3*a* (substrative layer); belt's elastic layer 3*b* laid on the peripheral surface of the substrate 3*a*; and the surface layer 3*c* laid on the outward surface of the belt's elastic layer 3*b*. The substrate 3*a* needs to heat resistant, and also, resistant to bending. Thus, a heat resistance resinous substance such as polyamide, polyamide-imide, and polyether-ether-ketone (PEEK), is used as the material for the substrate 3*a*. Further, in consideration of the fact that the substrate 3*a* has to be thermally conductive, a metallic substance such as stainless steel (SUS), nickel, and nickel alloy, which is higher in thermal conductivity than a heat resistant resinous substance, may be used as the material for the substrate 3*a*. Moreover, the substrate 3*a* has to be small in thermal capacity, and yet, has to be high in mechanical strength. Thus, the thickness of the substrate 3*a* is desired to be in a range of 5 μm-100 μm, preferably, 20 μm-85 μm.

The belt's elastic layer 3*b* is formed of silicon rubber. It covers the outward surface of the substrate 3*a*. While a sheet P of recording paper is conveyed through the fixation nip N, the belt's elastic layer 3*b* wraps around the unfixed toner T on the sheet P so that it gives heat to the unfixed toner T evenly across the toner T. Because the belt's elastic layer 3*b* functions as described above, it is possible to obtain a high quality image, that is, an image which is highly glossy and uniform in fixation. However, if the belt's elastic layer 3*b* is excessively thin, it fails to be elastic enough for the formation of a high quality image. On the other hand, if the belt's elastic layer 3*b* is excessively thick, the belt's elastic layer 3*b* becomes excessively large in thermal capacity, making the belt's elastic layer 3*b* longer in the length time necessary for the belt's elastic layer 3*b* (fixation belt 3) to be heated to the preset temperature level. Thus, thickness of the belt's elastic layer 3*b* is desired to be in a range of 30 μm-500 μm, preferably, 100 μm-300 μm.

There is no restriction regarding the material for the belt's elastic layer 3*b*. However, it is desired that the material for the belt's elastic layer 3*b* is easily processible at a high level of accuracy in measurement, and also, does not yield reactive byproducts when it is thermally cured. Therefore, it is desired that liquid silicone rubber of the addition cross-linking type is used as the material for the belt's elastic layer 3*b*. The liquid silicone rubber of the addition cross-linking type, which is used as the material for the belt's elastic layer 3*b*, may contain organopolysiloxane organohydrogen polysiloxane. Further, it may contain catalyst and/or other additives. Organopolysiloxane is the base polymer, the material for which is silicone rubber. It is desired to use such organopolysilixane that is in a range of 5,000-100,000 in numerical average molecular weight, and in a range of 10,000-500,000 in weight average molecular weight. The liquid silicone rubber is such polymer that remains fluid at room temperature, and hardens as it is heated. Even after it hardens, it remains relatively low in hardness, being proper in terms of hardness, sufficiently heat resistant, and resilient (elastic). Thus, liquid silicone rubber is suitable not only as the material for the belt's elastic layer 3*b*, but also, as the material for the nonporous elastic layer 4*b* and porous elastic layer 4*c* of the pressure roller 4, which will be described later.

By the way, in a case where the belt's elastic layer 3*b* is formed of pure silicon rubber, it is low in thermal conductivity. If the belt's elastic layer 3*b* is low in thermal conductivity, it is difficult for the heat generated by the heater 1 to conduct to a sheet P of recording paper through the fixation belt 3. Thus, the fixation nip N will be provided with an insufficient amount of heat when the sheet P is conveyed through the fixation nip N to fix the toner to the sheet P. Consequently, unsatisfactory images, for example, images which are non-uniform in fixation, might be outputted. Thus, in order to yield the belt's elastic layer 3*b* which is high in thermal conductivity, thermally highly conductive filler, which is in the form of a microscopic particle, for example, is dispersed in the material for the belt's elastic layer 3*b*. As for the choices of the thermally highly conductive filler which is in the form of a microscopic particle, particles of silicon carbide (SiC), zinc oxide (ZnO), alumina ($Al_2O_3$), aluminum nitride (AlN), magnesium oxide (MgO), carbon, or the like, are used. With regard to the shape of the thermally highly conductive filler, it may be in the form of a microscopic needle, depending on for what purpose the belt is to be used. In other words, it does not need to be in the form of a microscopic particle or needle. That is, it may be nonuniform in shape, in the form of a plate, or in the form of a whisker. That is, the shape of the filler to be dispersed in the material for the belt's elastic layer 3*b* may be any of the above listed ones. Further, various fillers which are different in shape may be used alone or in a combination of two or more. By the way, mixing thermally highly conductive filler into the material for the belt's elastic layer 3*b* provides the belt's elastic layer 3*b* with electrical conductivity.

The surface layer 3*c* is formed of fluorinated resinous substance. It covers the outward surface of the belt's elastic layer 3*b*. The surface layer 3*c* is provided to make it difficult for toner to adhere to the fixation belt 3. As the material for the surface layer 3*c*, fluorinated resinous substance such as copolymer of tetrafluoroethylene and perfluoroalkylvinylether (PFA), tetrafluoroethylene (PTFE), and copolymer of tetrafluoroethylene and hexafluoroether (FEP), can be used as desirable material. The thickness of the surface layer 3*c* is desired to be in a range of 1 μm-50 μm, preferably, 8 μm-25 μm. By the way, all that is required of the surface layer 3*c* is that the surface layer 3*c* is formed so that it covers the outward surface of the belt's elastic layer 3*b*. Thus, it may be formed by covering the outward surface of the belt's elastic layer 3*b* with a piece of fluorinated resin tube, or by coating the outward surface of the belt's elastic layer 3*b* with paint made of fluorinated resin.

[Pressure Roller]

Next, the pressure roller 4 is described. The pressure roller 4 has: a substrate 4*a*; an elastic rubber layer 4*b* formed on the peripheral surface of the substrate 4*a*; an elastic rubber layer 4*c* formed on the outward surface of the elastic rubber layer 4*b*; and a parting layer 4*d* formed on the outward surface of the elastic rubber layer 4*c*. In other words, the pressure roller 4 is formed by placing in layers, the nonporous elastic layer 4*b* as the first rubber layer, and the porous elastic layer 4*c* as the second rubber layer, in the listed order, on the peripheral surface of the metallic core 4*a*. That is, the characteristic feature of this pressure roller 4 is that the two elastic layers 4*b* and 4*c* are made different in function and properties.

Figure 2:
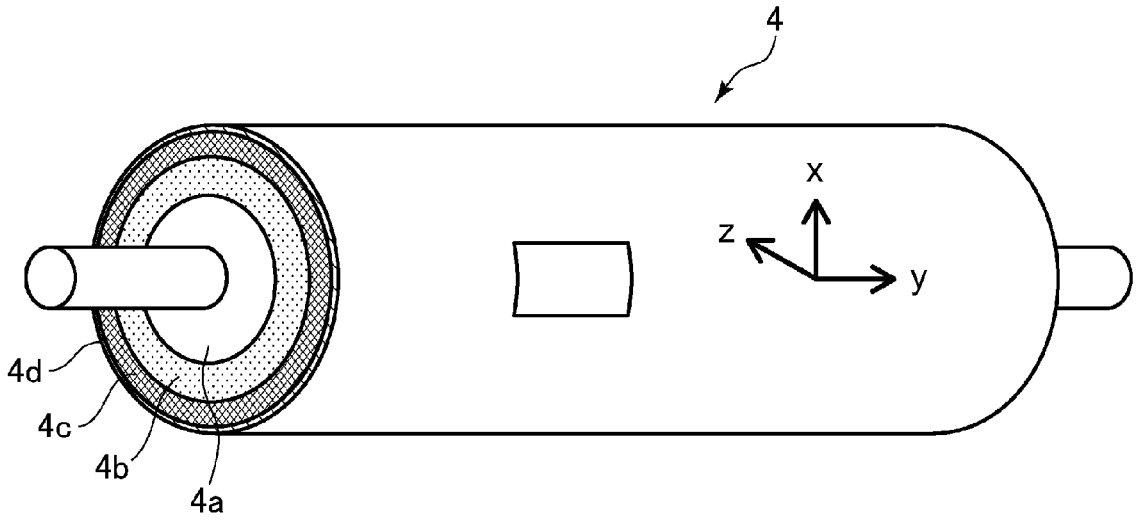
FIG. 2 is a perspective view of a typical pressure roller, and shows the overall structure of the pressure roller.
Figure 2:
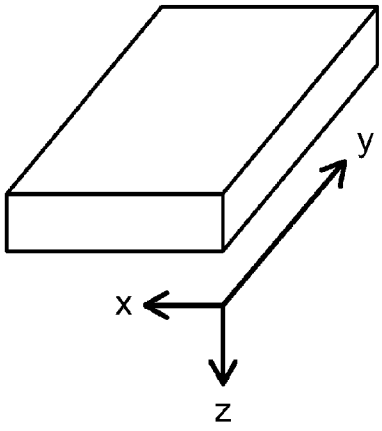
Figure 3:
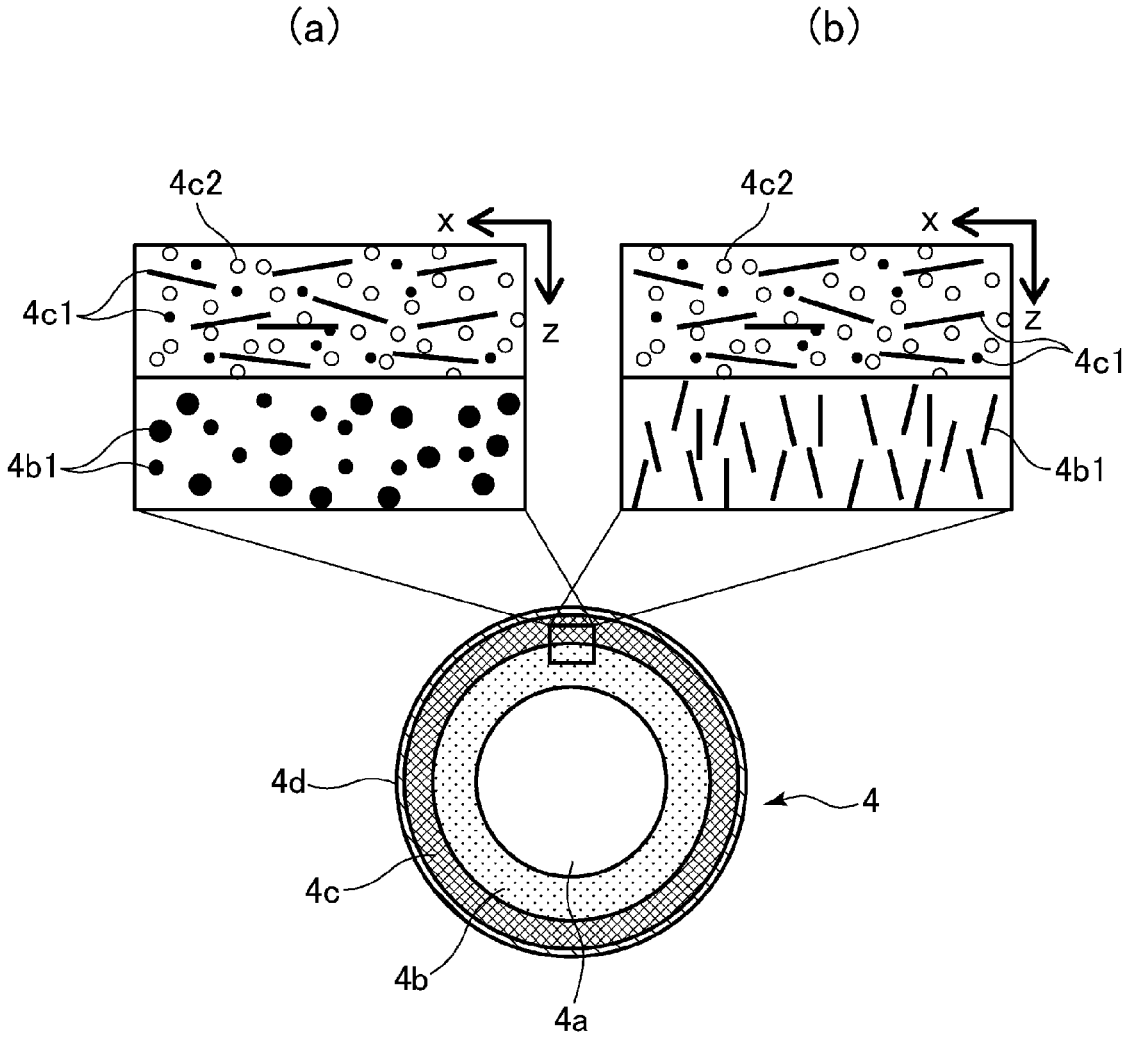
FIG. 3 is an enlarged sectional view of the nonporous and porous elastic layers of the pressure roller.

FIG. 2 is a perspective view of the pressure roller 4. It shows the overall structure of the roller 4. FIG. 3 is an enlarged sectional view of the combination of the nonporous and porous elastic layers 4*b* and 4*c*, at a plane which coincides with the two directions indicated by referential codes x and z. It shows the cross sections of the nonporous and porous elastic layers 4*b* and 4*c*. Hereinafter, the circumferential direction of the pressure roller 4 will be referred to as "direction x", and the lengthwise (axial) direction of the pressure roller 4 will be referred to as "direction y". Further, the thickness (thickness of layers) direction of the pressure roller 4 will be referred to as "direction z".

The substrate 4*a* is a metallic core formed of stainless steel which includes SUM (free cutting steel containing small amount of phosphor, sulphur, selenium, singularly or in combination) plated with nickel or chrome, phosphor copper, aluminum. The external diameter of the substrate 4*a* has only to be in a range of 4 mm-80 mm.

<Nonporous Elastic Layer>

The nonporous elastic layer 4*b* is formed of silicone rubber. It covers the peripheral surface of the substrate 4*a*. Unlike the porous elastic layer 4*c*, the nonporous elastic layer 4*b* has no pores (which will be described later). That is, it is a solid rubber layer. Referring to FIG. 3, the nonporous elastic layer 4*b* contains thermally highly conductive fillers 4*b*1, which are in the form of a microscopic particle, or in the form of a microscopic needle, and are dispersed in the layer 4*b*. FIG. 3(*a*) shows the nonporous elastic layer 4*b* which contains the thermally highly conductive fillers 4*b*1, which are in the form of a microscopic particle, whereas FIG. 3(*b*) shows the nonporous elastic layer 4*b* which contains the thermally highly conductive fillers 4*b*1, which are in the form of a microscopic needle.

Next, the thermally highly conductive filler 4*b*1 which is in the form of a microscopic particles or needle is described. As the thermally highly conductive filler 4*b*1 which is in the form of a microscopic particle, particles of silicon carbide (SiC), zinc oxide (ZnO), alumina ($Al_2O_3$), aluminum nitride (AlN), magnesium oxide (MgO), carbon, or the like, are used as they are used for the belt's elastic layer 3*b* of the fixation belt 3. In this embodiment, the presence of the thermally highly conductive fillers 4*b*1 which are in the form of a microscopic particle, in the nonporous elastic layer 4*b* makes the thermal conductivity of the nonporous elastic layer 4*b* in the thickness direction of the (direction z) greater than that in the porous elastic layer 4*c*. More concretely, in order to make the thermal conductivity of the nonporous elastic layer 4*b* in the thickness direction (direction z) no less than 0.50 W/(m·k), thermally highly conductive fillers 4*b*1 which are in the form of a microscopic particle are dispersed in the material for the nonporous elastic layer 4*b*.

As the thermally highly conductive needle-like fillers 4*b*1 (which hereafter will be referred to as needle-like fillers 4*b*1), pitch-based (tar-based) carbon fiber which is no less than 500 W/(m·k) in thermal conductivity in the lengthwise direction of the filler is used. Pitch (tar)-based carbon fiber is carbon fiber manufactured from the byproduct of petroleum refining process, or coal carbonizing process. One of its characteristic features is that it is virtually zero in thermal expansion while it is thermally highly conductive. A needle-like filler 4*b*1 is in the form of a long and narrow rod which is circular or polygonal in cross section. That is, it is a filler, the ratio of the length of which relative to its diameter is large, that is, a filler which is high in aspect ratio. A compound containing needle-like filler is anisotropic in thermal conduction; it conducts heat more easily in its lengthwise direction (direction in which filler is aligned) than in its diameter direction. Referring to FIG. 3(*b*), in this embodiment, the needle-like fillers 4*b*1 dispersed in the nonporous elastic layer 4*b* are roughly parallel in the thickness direction (direction z) of the nonporous elastic layer 4*b*. Thus, the thermal conductivity of nonporous elastic layer 4*b* in the thickness direction (direction z) is higher than that of the porous elastic layer 4*c*.

The pitch-based carbon fiber used as the needle-like fillers 4*b*1 for the nonporous elastic layer 4*b* is desired to be 5 μm-11 μm in average diameter, and 50 μm-1,000 μm in average length, because if it is shorter than 50 μm in average length, it is likely to fail to give the nonporous elastic layer 4*b* anisotropic properties in terms of thermal conductivity. On the other hand, if it is longer than 1,000 μm in average length, it is difficult to be dispersed in the material for the nonporous elastic layer 4*b*.

The amount of the thermally highly conductive fillers 4*b*1, which are in the form of a microscopic particle or needle, dispersed in the nonporous elastic layer 4*b* is desired to be in the range of 5%-60% in volume for the following reason. That is, if the amount of the thermally highly conductive fillers 4*b*1 dispersed in the nonporous elastic layer 4*b* is no more than 5% in volume, the fillers 4*b*1 fails to sufficiently increase the nonporous elastic layer 4*b* in thermal conductivity to prevent the occurrence of the out-of-sheet-path temperature increase. On the other hand, if it is no less than 60% in volume, it substantially reduces the liquid silicone rubber in fluidity, making it difficult to mold the liquid silicone rubber into the nonporous elastic layer 4*b*. In addition, it increases the silicone rubber (nonporous elastic layer 4*b*) in terms of post-curing hardness, preventing the silicone rubber (nonporous elastic layer 4*b*) from functioning as an elastic layer, as will be described later. By the way, the choice of the thermally highly conductive filler 4*b*1 may be only one among the various fillers different in shape, for example, in the form of a microscopic particle or needle, or combination of two or more which are different in shape.

<Porous Elastic Layer>

The porous elastic layer 4*c* is also a silicone rubber layer. It covers the outward surface of the nonporous elastic layer 4*b*. There are a large amount of pores in the porous elastic layer 4*c*. It is the so-called foamed rubber layer. Referring to FIGS. 3(*a*) and 3(*b*), the porous elastic layer 4*c* contains thermally highly conductive needle-like fillers 4*c*1 (which hereafter will be referred to simply as "needle-like filler 4*c*1") which are oriented roughly in parallel in the lengthwise direction (direction perpendicular to surface of sheet of paper on which FIG. 3 is drawn), as well as in the circumferential direction (left-right direction of FIG. 3). The above described pitch-based carbon fiber is also used as the needle-like filler 4*c*1 for the porous elastic layer 4*c*. Containing the needle-like fillers 4*c*1 dispersed as described above, the porous elastic layer 4*c* also displays anisotropic properties in terms of thermal conductivity. In this embodiment, the porous elastic layer 4*c* is formed so that its thermal conductivity in the directions (directions x and y) parallel to the peripheral surface of the pressure roller 4, in particular, the lengthwise direction and circumferential direction, is higher than that in the thickness direction. More concretely, the thermal conductivity of the porous elastic layer 4*c* in the lengthwise direction, and that in the circumferential direction, were made 6-20 times greater than that in the thickness direction (Table 1 which will be provided later).

Further, the porous elastic layer 4*c* is provided with a large number of pores 4*c*2 which are different from those in the nonporous elastic layer 4*b*. The pores 4*c*2 are provided to reduce the porous elastic layer 4*c* in thermal capacity. Providing the porous elastic layer 4*c* with the large number of pores 4*c*2 makes the thermal conductivity of the porous elastic layer 4*c* in the thickness direction lower than that in the lengthwise direction. That is, the provision of the pores 4*c*2 in the porous elastic layer 4*c* also contributes to make the thermal conductivity of the nonporous elastic layer 4*b* in the thickness direction higher than that of the porous elastic layer 4*c*.

The porous elastic layer 4*c* and nonporous elastic layer 4*b* are formed so that they become roughly uniform in thickness. The thickness of the porous elastic layer 4*c* has only to be in a range of 0.3 mm-5.0 mm, preferably, no less than 0.5 mm. In comparison, the nonporous elastic layer 4*b* does not need to regulate in thickness. That is, the thickness of the nonporous elastic layer 4*b* is to be adjusted according to the thickness and hardness of the porous elastic layer 4*c*. In other words, the thickness of the nonporous elastic layer 4*b* has only to be such that the nonporous elastic layer 4*b* can form the fixation nip N having the preset width, as the combination of itself and porous elastic layer 4*c* is elastically deformed when the combination is pressed upon the fixation belt 3. However, the thickness of the combination of the nonporous elastic layer 4*b* and porous elastic layer 4*c* is desired to be in a range of 2.0 mm-10.0 mm. By the way, from the standpoint of ensuring that the fixation nip N is formed so that it will have the preset width, the hardness of the porous elastic layer 4*c* is desired to be in a range of 20°-70°.

<Parting Layer>

The parting layer 4*d* is a fluorinated resin layer. It is formed by covering the outward surface of the porous elastic layer 4*c* with a piece of tube made of a copolymer (PFA). It may be formed by coating the outward surface of the porous elastic layer 4*c* with paint made of such fluorinated resin as PFA, polytetrafluoroethylene (PTFE), and copolymer of tetrafluoroethylene and hexafluoropropyrene (FEP). There is no specific requirement regarding the thickness of the parting layer 4*d*. However, it is preferred to be in a range of 15-80 μm. This parting layer 4*d* is provided to make it difficult for toner to adhere to the pressure roller 4.

By the way, there is provided between the nonporous elastic layer 4*b* and porous elastic layer 4*c*, and between the porous elastic layer 4*c* and parting layer 4*d*, a primer layer (adhesive layer) for keeping the adjacent two layers adhered to each other.

[Method for Forming Nonporous Elastic Layer]

Next, the methods for forming the nonporous elastic layer 4*b*, porous elastic layer 4*c*, and parting layer 4*d* are described. First, the method for forming the nonporous elastic layer 4*b* is described. There is no specific requirement regarding the method for forming the nonporous elastic layer 4*b*. Here, however, a preferred method for forming the nonporous elastic layer 4*b* is an ordinary method which uses a mold, or a ring coating method. Here, a ring coating method is described as an example.

The substrate 4*a* is coated in advance with primer. Then, the primed substrate 4*a* is held by a holding member so that the rotational axis of the substrate 4*a* becomes vertical. Then, a coating head which is in the form of a ring is disposed so that it surrounds the substrate 4*a* held by the holding member. The paint nozzles of the ring-shaped coating head are on the inward surface of the head. In an operation for forming the elastic layer 4*b* or 4*c*, the mixture of liquid rubber, fillers, additives, etc., which will be described later, is projected toward the peripheral surface of the substrate 4*a* while the substrate 4*a* is moved up and down. This is how a layer of the liquid rubber mixture is formed on the peripheral surface of the substrate 4*a*. Then, the vertically positioned substrate 4*a* is horizontally positioned. Next, the substrate 4*a* is rotated at 60 rpm, for example, while it is heated by a near-infrared heater or the like, until the surface temperature of the substrate 4*a* becomes roughly 180° C. Then, while its surface temperature is kept at roughly 180° C., the substrate 4*a* is rotated for three minutes to thermally harden (cure) the liquid silicone rubber. Thereafter, the substrate 4*a* covered with the hardened liquid silicone rubber compound is heated in an oven of the so-called heated air circulation type, which is set to 200° C. to further harden the silicone rubber (secondary hardening). This is how the nonporous elastic layer 4*b* is formed on the peripheral surface of the substrate 4*a*.

As the material for the nonporous elastic layer 4*b*, a mixture formed by dispersing thermally highly conductive fillers 4*b*1, which are in the form of a microscopic particle or needle, in liquid silicone rubber is used. In a case where a mixture formed by dispersing the needle-like filler 4*b*1 in liquid silicone rubber is used as the material for the nonporous elastic layer 4*b*, as the needle-like fillers 4*b*1 are ejected, along with the liquid silicone rubber, from the nozzles of the ring-shaped head, they automatically become roughly parallel to the direction in which the liquid silicone rubber flows. Thus, the needle-like fillers 4*b*1 can be orientated in the direction in which heat is to be conducted more, by making the liquid silicone rubber to flow in the same direction as the direction in which heat is to be conducted more. That is, in this embodiment, the direction in which the liquid silicone rubber is to be flowed is matched with the thickness direction (direction z) of the nonporous elastic layer 4*b* to make the thermal conductivity of the nonporous elastic layer 4*b* in the thickness direction higher, in order to make it easier for heat to conduct from the nonporous elastic layer 4*b* to the substrate 4*a*.

[Method for Forming Porous Elastic Layer]

The method for forming the porous elastic layer 4*c*, and that for forming the parting layer 4*d*, will be described.

(1) Production of Liquid Rubber Compound

The liquid rubber compound is produced by mixing needle-like fillers 4*c*1, and hydrous polymer soaked with water, into liquid silicone rubber. More concretely, all that has to be done is to obtain a preset amount of liquid silicone rubber, a preset amount of needle-like fillers 4*c*1, and a preset amount of hydrous substance, with the use of a scale, and stir the mixture of these substances with the use of one of known filler mixing/stirring means such as a universal mixer/stirrer of the so-called planetary type.

(2) Formation of Liquid Silicone Rubber Compound into Porous Elastic Layer

There is no specific restriction regarding the method for forming the porous elastic layer 4*c*. Here, however, one of the commonly used methods which use a mold is described. Before the porous elastic layer 4*c* is formed, the outward surface of the nonporous elastic layer 4*b* is coated in advance with primer. Then, the substrate 4*a* covered with the primed nonporous elastic layer 4*b* is placed in a metallic mold. Then, the liquid silicone rubber compound is poured into the metallic mode in such a manner that it flows in the direction parallel to the axial line of the substrate 4*a*. As the liquid silicone rubber compound is poured into the metallic mold in the above-described manner, most of the needle-like fillers 4*c*1 are oriented by the flow of the liquid silicone rubber, in the direction parallel to the axial line of the substrate 4*a*, that is, the lengthwise direction (direction y) of the pressure roller 4. Thus, the thermal conductivity of the porous elastic layer 4*c* in the lengthwise direction becomes higher than that in other directions. Therefore, as the temperature of the out-of-sheet-path portions begin to rise, it is likely for heat to conduct from the out-of-sheet-path portions to the sheet-path portion, and also, to the lengthwise end portions of the pressure roller 4, which are relatively low in temperature. In other words, it is possible to efficiently disperse the heat in the out-of-sheet-path portions, from the out-of-sheet-path portions.

By the way, even if the liquid silicone rubber compound is poured into the metallic mold in the direction parallel to the axial line of the substrate 4*a*, the liquid silicone rubber flow is sometimes disturbed in the metallic mold. In such a case, the liquid silicone rubber compound may flow in the direction in which a sheet P of recording paper is conveyed, that is, the circumferential direction (direction x) of the pressure roller 4, or the directions (including direction y) which are intersectional to the circumferential direction. Thus, even though most of the needle-like fillers 4*c*1 are oriented roughly in parallel to the lengthwise direction in the porous elastic layer 4*c*, some of them are oriented roughly in the directions (directions x and y, including lengthwise and circumferential directions) parallel to the peripheral surface of the pressure roller 4. In such a case, the needle-like fillers 4*c*1 increase the thermal conduction not only in the lengthwise direction, but also, in the circumferential direction. This, however, is not problematic at all, because the increase in the thermal conduction in the circumferential direction is also effective to impede the out-of-sheet-path portion temperature increase. That is, as long as the orientation of the needle-like fillers 4*c*1 in the porous elastic layer 4*c* is parallel to the surface of the porous elastic layer 4*c* (directions x and y), they are effective to impede the out-of-sheet-path portion temperature increase, regardless of direction.

(3) Hardening of Liquid Silicone Rubber by Cross-Linking

After the metallic mold is filled with liquid silicone rubber compound, the metallic mold is sealed and heated. That is, the liquid rubber compound in the metallic mold is heated, together with the metallic mold, for 5-120 minutes at a temperature level which is no higher than the boiling point of water, for example, a temperature level in a range of 60° C.-90° C. As the liquid rubber compound is heated while remaining sealed in the metallic mold, the silicone rubber in the compound hardens by cross-linking while retaining the water in the hydrous substance.

(4) Extraction of Pressure Roller from Mold

The heated metallic mold is water-cooled or air-cooled. Then, the pressure roller 4 is extracted from the metallic mold. After the extraction of the pressure roller 4 from the mold, there is the porous elastic layer 4*c* on the outward surface of the nonporous elastic layer 4*b*.

(5) Formation of Pores

The extracted pressure roller 4 is heated. As the internal temperature of the porous elastic layer 4*c* is increased by the heating, the water in the hydrous substance evaporates, forming thereby pores 4*c*2 where water was present. Regarding how the pressure roller 4 is to be heated, it is desired that the temperature level at which the pressure roller 4 is to be heated is set to a level in a range of 100° C.-250° C., and the length of time the pressure roller 4 is to be heated is set to a value in a range of 1-5 hours. This is how the porous elastic layer 4*c* containing needle-like fillers 4*c*1 and pores 4*c*2 is formed on the outward surface of the nonporous elastic layer 4*b*.

(6) Formation of Parting Layer

The parting layer 4*d* is formed by covering the porous elastic layer 4*c* with a piece of fluorinated resin tube. Generally speaking, adhesive is used to keep the porous elastic layer 4*c* covered with a piece of fluorinated resin tube. However, there are cases where the fluorinated resin tube can be kept adhered to the porous elastic layer 4*c* without using adhesive. In such cases, the usage of adhesive is optional. Further, the parting layer 4*d* may be formed by coating the outward surface of the porous elastic layer 4*c* with paint made of fluorinated resin, or the like paint. Moreover, the parting layer 4*d* may be formed together with the porous elastic layer 4*c*, with use of the following method. That is, a piece of fluorinated resin tube is disposed in advance on the inward surface of the metallic mold. Then, the substrate 4*a* on which the nonporous elastic layer 4*b* has been formed is placed in the metallic mold having the fluorinated resin tube on its inward surface. Then, liquid rubber compound is poured between the nonporous elastic layer 4*b* and fluorinated resin tube. That is, the porous elastic layer 4*c* is formed after the formation of the parting layer 4*d*. In a case where the fluorinated resin tube is placed in the metallic mold, its inward surface is etched, coated with primer, and dried, in advance.

[Evaluation of Pressure Roller]

Next, the evaluation of the pressure roller 4 is described with reference to the pressure roller 4 in the first embodiment, and comparative pressure rollers 1-3. Here, the thermal conductivity of each pressure roller was obtained for evaluation.

<Thermal Conductivity>

Thermal conductivity was obtained by converting thermal diffusivity into thermal conductivity. As the means for measuring the thermal diffusivity of the pressure rollers, an apparatus of such a variable temperature type that measures the thermal diffusivity with the use of the temperature wave thermal analysis. An example of this type of apparatus is "ai-Phase Mobile 2" (commercial name: product of ai-Phase Co., Ltd.) This apparatus was used to measure the thermal diffusivity of each pressure roller, like the one shown in FIG. 2(*a*), in the circumferential direction (x), lengthwise direction (y), and thickness direction (z). Referring to FIG. 2(*b*), in order to measure the thermal diffusivity of each pressure roller in the circumferential direction (x), a test piece was obtained by cutting each pressure roller in the directions x, y and z so that the dimension of the test piece in the direction x becomes no more than 1 mm. In order to measure the thermal diffusivity of each pressure roller in the lengthwise direction (y), a test piece was obtained by cutting the pressure roller in the directions x, y and z so that the dimension of the test piece in the lengthwise direction (y) becomes no more than 1 mm. In order to measure the thermal diffusivity of each pressure roller in the thickness direction (z), a test piece was obtained by cutting the pressure roller in the x, y and z directions so that the dimension of the test piece in the thickness direction (z) became no more than 1 mm. The thermal diffusivity of each of these test pieces in each direction was measured five times at 50° C. Then, the average of the five values obtained through the five measurements was accepted as the thermal diffusivity in the circumferential direction, thermal diffusivity in the lengthwise direction, and thermal diffusivity in the thickness direction of each pressure roller.

In order to convert thermal diffusivity into thermal conductivity, both the density and thermal capacity of each pressure roller are necessary. As for the means for measuring the density of each test piece, a dry automatic densitometer, more specifically, "Accupyc 1330" (commercial name: product of Shimadzu Co., Ltd.), for example, is used. As for the means for measuring the specific heat capacity, a differential scanning calorimeter, more specifically, "DSC 823" (commercial name: product of Mettler-Toledo Co., Ltd.), for example, was used. As for a substance, the specific thermal capacity of which is known and is to be used as a reference for obtaining the specific thermal capacity of each pressure roller, sapphire was used. The specific thermal capacity of each pressure roller was measured five times by this measuring device, and the average of the five values obtained by the measurement was accepted as the specific thermal capacity of the pressure roller. Then, the thermal conductivity of each pressure roller was obtained by multiplying the obtained density by the obtained specific thermal capacity, and then, multiplying the result of the multiplication by the above described thermal diffusivity.

<Performance Evaluation>

The performance of each of the pressure roller 4 in the first to fourth embodiments, and comparative pressure rollers 1-3 was evaluated with the use of a laser printer in which each pressure roller was installed. During the formation of a test images by this laser printer, the rotational speed (peripheral velocity) of the pressure roller was kept at 246 mm/sec.

(Evaluation of Out-of-Sheet-Path Portion Temperature Increase)

The evaluation of each pressure roller in terms of out-of-sheet-path portion temperature increase was made based on the surface temperature of the out-of-sheet-path portions of the fixation belt 3, which was measured after a test image was continuously printed in landscape mode for 10 minutes at a rate of 50 sheets/min, using A4 size sheets of paper "CS-680" (commercial name: product of Canon Co., Ltd.). More concretely, 500 prints were continuously outputted while controlling the heater 1 so that the temperature of the fixation belt 3, which was measured at 90° upstream, in terms of recording medium conveyance direction, from the fixation nip N (FIG. 1), remained at 170° C. Then, immediately after 500 prints were continuously outputted, the surface temperature of the out-of-sheet-path portions of the fixation belt 3 (portions of fixation belt 3, which were outside path of A4 size sheet) was measured with the use of a thermometer of the so-called radiation type. In consideration of the fact that in order to fix an unfixed toner image to recording medium, the fixation belt 3 has to be heated so that its temperature rises to a preset level (200° C., for example), if the measured surface temperature of the out-of-sheet-path portions of the fixation belt 3 was no higher than 250° C., it was determined that the occurrence of the out-of-sheet-path portion temperature increase was prevented.

(Evaluation of Pressure Roller in Terms of Length of Startup Time)

The pressure rollers were evaluated in terms of the startup time (length of time it takes for temperature of fixation belt 3 to increases to above described preset level after heat 1 begins to be supplied with electric power) under a low temperature/low humidity environment (15° C./10%), as it was in terms of out-of-sheet-path portion temperature increase. The startup time was measured as the length of time it took for the surface temperature of the fixation belt 3 to rise to 170° C. after the heater 1 began to heat the fixation belt 3, while the fixing device 10 was idled, that is, the fixation belt 3 was not conveying a sheet of recording paper. Here, when the startup time was shorter than 10.8 seconds, it was determined that the startup time was shortened.

<Results of Evaluation>

The evaluation of the pressure rollers in the embodiments 1-4, and comparative pressure rollers 1-3, regarding the surface temperature of their out-of-sheet-path portions, and startup time of their fixing members, are given, along with the measured thermal conductivity of each pressure roller, in Table 1. As is evident from Table 1, thermal conductivity (λy) in the lengthwise direction and the thermal conductivity (λx) in the circumferential direction, were no less than six times the thermal conductivity (λz) in the thickness direction.

TABLE 1

| | porous elastic layer 4b | | | | non-porous elastic layer 4c | | | | | | | temp. of non-sheet area | |
|---|---|---|---|---|---|---|---|---|---|---|---|---|---|
| | *1 | | *2 | | whisker filler | | | thermal conductivity | | | | | |
| | kinds | cont. | λz | *3 | kinds | cont. | porosity | λx | λy | λz | *3 | | up time |
| | | | | | | units | | | | | | | |
| | — | vol. % | W/(m · K) | mm | — | vol % | vol % | W/(m · K) | W/(m · K) | W/(m · K) | mm | ° C. | sec. |
| Emb. 1 | CB-A20S | 50 | 1.5 | 1.0 | XN-100-25M | 10 | 50 | 2.4 | 3.5 | 0.15 | 2.0 | 220 | 9.6 |
| Emb. 2 | CB-A20S | 50 | 1.5 | 1.5 | XN-100-10M | 20 | 50 | 2.1 | 2.8 | 0.14 | 1.5 | 235 | 9.5 |
| Emb. 3 | XN-100-10M | 25 | 2.8 | 1.0 | XN-100-20M | 15 | 50 | 2.7 | 3.9 | 0.16 | 2.0 | 210 | 10.0 |
| Emb. 4 | CB-A20S | 50 | 1.5 | 1.5 | XN-100-10M | 10 | 30 | 1.1 | 2.2 | 0.18 | 1.5 | 245 | 10.7 |
| Comp. 1 | — | — | 0.2 | 1.0 | XN-100-25M | 10 | 50 | 2.4 | 3.5 | 0.15 | 2.0 | 250 | 9.5 |

TABLE 1-continued

| | porous elastic layer 4b | | | | non-porous elastic layer 4c | | | | | | | temp. of non-sheet | |
|---|---|---|---|---|---|---|---|---|---|---|---|---|---|
| | *1 | | *2 | | whisker filler | | | thermal conductivity | | | | | |
| | kinds | cont. | λz | *3 | kinds | cont. | porosity units | λx | λy | λz | *3 | area | up time |
| | — | vol. % | W/(m · K) | mm | — | vol % | vol % | W/(m · K) | W/(m · K) | W/(m · K) | mm | ° C. | sec. |
| Comp. 2 | CB-A20S | 50 | 1.5 | 1.5 | XN-100-10M | 20 | 0 | 2.2 | 2.9 | 0.40 | 1.5 | 230 | 12.0 |
| Comp. 3 | XN-100-10M | 25 | 2.8 | 1.0 | — | — | 50 | 0.13 | 0.13 | 0.13 | 2.0 | 260 | 9.2 |

*1 thermally conductive filler
*2 thermal conductivity
*3 thickness

The substrates 4*a* of all of the pressure rollers in the embodiments 1-4, and comparative pressure rollers 1-3, were metallic cores made of iron, and were 24 mm in external diameter. The primer coated on the peripheral surface of the metallic core was "DY39-051" (commercial name: product of Dow-Corning Co., Ltd.). The pressure rollers 4 were 30 mm in external diameter. The sum of the thickness of the nonporous elastic layer 4*b* and that of the porous elastic layer 4*c*, that is, the thickness of the combination of two elastic layers, was 3.0 mm.

(Pressure Roller in Embodiment 1)

As for the liquid rubber compound as the material for the nonporous elastic layer 4*b*, a compound made by dispersing microscopic particles of alumina "Alunabeads CB-A20S" (commercial name: product of Showa Denko Co., Ltd.), as thermally highly conductive filler 4*b*1, in liquid silicone rubber of the addition reaction cross-linking type, was used. As for the liquid rubber compound as the material for the porous elastic layer 4*c*, a compound obtained by dispersing sodium polyacrylate "Reojikku 250H" (commercial name: product of Japan Pure Chemical Co., Ltd.), as hydrous substance, in the liquid silicone rubber, by 50% in volume. Further, the ratio of the poly-sodium acrylate in the hydrous substance was made to be 1% in weight volume after the hydrous substance was soaked with water. Moreover, the needle-like fillers 4*c*1 were mixed in the liquid rubber compound as the material for the porous elastic layer 4*c*, by 10% in volume. In the first embodiment, pitch-based carbon fiber "GRANOC milled fiber (XN-100-25M)" (commercial name: product of Nippon Graphite Fiber Co., Ltd.), which was 250 μm in average length was used as the needle-like filler 4*c*1. This pitch-based carbon fiber was 9 μm in average diameter, and 900 W/(m·k) in the thermal conductivity in its lengthwise direction (which hereafter are the same). Also in the first embodiment, the porous elastic layer 4*c* was made to be 2.0 mm in thickness. By the way, because the porous elastic layer 4*c* was made to be 2.0 mm in thickness, and the combination of both elastic layers was made to be 3.0 mm in thickness, the nonporous elastic layer 4*b* was 1.0 mm in thickness. The structure of the nonporous elastic layer 4*b* and porous elastic layer 4*c* of the pressure roller 4 in the first embodiment are as shown in FIG. 3(*a*).

(Pressure Roller in Embodiment 2)

The liquid rubber compound used as the material for the nonporous elastic layer 4*b* was the same as the one in the first embodiment. In comparison, the liquid rubber compound used as the material for the porous elastic layer 4*c* contained needle-like filler 4*c*1 by 20% in volume. In the second embodiment, pitch-based carbon fiber "GRANOC milled fiber (XN-100-10M)" (commercial name: product of Nippon Graphite Fiber Co., Ltd.), which was 100 μm in average length, was used as the needle-like filler 4*c*1. The hydrous substance used in this embodiment was the same as the one in the first embodiment. In the second embodiment, however, the nonporous elastic layer 4*c* was made to be 1.5 mm in thickness, and the porous elastic layer 4*c* was made to be 1.5 mm in thickness. The structure of the nonporous elastic layer 4*b* and porous elastic layer 4*c* of the pressure roller 4 in the second embodiment are as shown in FIG. 3(*a*).

(Pressure Roller in Embodiment 3)

As for the liquid rubber compound as the material for the nonporous elastic layer 4*b*, a compound obtained by dispersing needle-like filler, as thermally highly conductive filler 4*b*1, in liquid silicone rubber of the addition reaction cross-linking type by 25% in volume, was used. As the needle-like fiber 4*b*1, the above described pitch-based carbon fiber "GRANOC milled fiber (XN-100-10M)", which was 100 μm in average length, was used. In comparison, as the material for the porous elastic layer 4*c*, a liquid rubber compound which contained needle-like filler 4*c*1 by 15% in volume was used. In the third embodiment, pitch-based carbon fiber "GRANOC milled fiber (XN-100-20M)" (commercial name: product of Nippon Graphite Fiber Co., Ltd.), which was 200 μm in average length was used as the needle-like filler 4*c*1. The hydrous substance used in this embodiment was the same as the one used in the first embodiment. Further, in the third embodiment, the thickness of the nonporous elastic layer 4*b*, and that of the porous elastic layer 4*c*, were made to be the same as those in the first embodiment, which were 1.0 mm and 2.0 mm, respectively. The structure of the nonporous elastic layer 4*b* and porous elastic layer 4*c* of the pressure roller 4 in the third embodiment are as shown in FIG. 3(*b*).

(Pressure Roller in Embodiment 4)

The liquid rubber compound as the material for the nonporous elastic layer 4*b* in this embodiment was the same as that in the first embodiment. In comparison, the liquid rubber compound used as the material for the porous elastic layer 4*c* in this embodiment was practically the same as that in the first embodiment, except that it is by 10% in volume that the pitch-based carbon fiber (above-described XN-100-10M) was mixed, and the ratio of the hydrous substance was 30% in volume. Further, in the fourth embodiment, the nonporous elastic layer 4*b* and porous elastic layer 4*c* were made to be 1.5 mm and 1.5 mm, respectively, in thickness. The structure of the nonporous elastic layer 4*b* and porous elastic layer 4*c* of the pressure roller 4 in the fourth embodiment are as shown in FIG. 3(*a*).

(Comparative Pressure Rollers 1-3)

The comparative pressure roller 1 is different from the pressure roller 4 in the first embodiment in that its nonporous elastic layer 4*b* does not contain thermally highly conductive filler 4*b*1. The comparative pressure roller 2 is different from the pressure roller 4 in the comparative pressure roller 2 in that its porous elastic layer 4*c* does not have pores 4*c*2 (zero in pore ratio). The comparative pressure roller 3 is different from the pressure roller 4 in the third embodiment in that its porous elastic layer 4*c* does not contain the needle-like fillers 4*c*1.

It is evident from the test results of the comparative pressure rollers 1-3 that the comparative pressure rollers 1-3 can offer only one of the two effects which the pressure rollers in the embodiments of the present invention can offer. That is, the comparative pressure rollers are effective either to prevent the occurrence of the out-of-sheet-path portion temperature increase or reducing the startup time of the fixing members. More concretely, in the case of the comparative pressure roller 1, the temperature of the out-of-sheet-path portions was 250° C. In other words, it could not prevent the occurrence of the out-of-sheet-path portion temperature increase, for the following reason. That is, the nonporous elastic layer 4*b* of the comparative pressure roller 1 did not contain the thermally highly conductive fillers 4*b*1. Therefore, it is difficult for the heat in the out-of-sheet-path portions to conduct to the sheet-path portion, lengthwise ends of the pressure roller, and also, the substrate 4*a* of the pressure roller 1. In the case of the comparative pressure roller 2, the temperature of its out-of-sheet-path portions was 230° C. That is, it prevented the occurrence of the out-of-sheet-path portion temperature increase. However, its startup time was 12.0 seconds, being rather long, for the following reason. That is, its porous elastic layer 4*c* did not have the pores 4*c*2, being therefore higher in thermal conductivity. Thus, as the fixing members were heated, the heat in the fixing members easily conducted to the pressure roller. In the case of the comparative pressure roller 3, the startup time was 9.2 seconds, which is relatively short. However, its out-of-sheet-path portion temperature was 260° C., which was relatively high. That is, the comparative pressure roller 3 failed to prevent the occurrence of the out-of-sheet-path portion temperature increase. This result is attributable to the fact that the porous elastic layer 4*c* of the comparative pressure roller 3 did contain the needle-like fillers 4*c*1. Therefore, it was easier for heat in the out-of-sheet-path portions to conduct to the sheet-path portion, and the lengthwise end portions of the pressure roller 4.

In comparison, the test results of the pressure rollers 4 in the first to fourth embodiments show that all of the pressure rollers in the first to fourth embodiments were no higher than 250° C. in out-of-sheet-path portion temperature increase, and no more than 10.8 seconds in startup time. That is, they were effective in both the prevention of the occurrence of the out-of-sheet-path portion temperature increase, and the shortening of the startup time.

Next, the effect of reducing the startup time is described. In the case of the pressure rollers in the first to fourth embodiment, their porous elastic layer 4*c* was reduced in thermal conductivity by the provision of the pores 4*c*2 in the porous elastic layer 4*c*. If the porous elastic layer 4*c* is low in thermal conductivity, it is difficult for heat to conduct from the fixation belt 3 to the pressure roller 4. Further, it is in a case where the amount of heat stored in the porous elastic layer 4*c*, which is low in thermal capacity, exceeds the thermal capacity of the porous elastic layer 4*c*, that heat conducts from the porous elastic layer 4*c* to the nonporous elastic layer 4*b*. Therefore, it does not occur that heat conducts from the porous elastic layer 4*c* to the nonporous elastic layer 4*b* during the startup period (warm-up period) in which the amount by which heat is generated is relatively small. Therefore, the pressure rollers in the first to fourth embodiments were shorter in the startup time.

Next, the effect of the pressure rollers in the first to fourth embodiment upon the prevention of the occurrence of the out-of-sheet-path portion temperature increase is described. In the case of the pressure rollers in the first to fourth embodiments, the heat in the out-of-sheet-path portions escapes to the sheet-path portion and the lengthwise end portions of the pressure roller though the needle-like fillers 4*c*1 in the porous elastic layer 4*c*. In addition, as heat conducts from the porous elastic layer 4*c* to the nonporous elastic layer 4*b*, this heat escapes to the substrate 4*a* (metallic core) through the thermally highly conductive filler 4*b*1 in the nonporous elastic layer 4*b*. That is, it is possible to make the heat in the out-of-sheet-path portions to escape through the substrate 4*a* (metallic core), which is higher in thermal conductivity than the nonporous elastic layer 4*b* and porous elastic layer 4*c*. Incidentally, the reason why the out-of-sheet-path portion temperature (210° C.) of the pressure roller 4 in the third embodiment was lower than those in the other embodiments is that in the third embodiment, such needle-like filler that is anisotropic in thermal conductivity was used as the thermally highly conductive filler 4*b*1 for the nonporous elastic layer 4*b*.

As described above, in the case of the pressure rollers in the preceding embodiments of the present invention, their elastic layer was made up of two elastic sublayers, more specifically, the nonporous elastic layer 4*b* and porous elastic layer 4*c*, which are different in properties. As for the characteristic of the nonporous elastic layer 4*b*, its thermal conductivity ($\lambda z$) in the thickness direction is higher than the thermal conductivity ($\lambda z$) of the porous elastic layer 4*c* in the thickness direction. As for the characteristic of the porous elastic layer 4*c*, its thermal conductivity ($\lambda y$) in the lengthwise direction, and its thermal conductivity ($\lambda x$) in the circumferential direction are higher than the thermal conductivity ($\lambda z$) in the thickness direction. Further, thermal conductivity ($\lambda z$) of the porous elastic layer 4*c* in the thickness direction is lower than the thermal conductivity ($\lambda z$) of the nonporous elastic layer 4*b* in the thickness direction. Moreover, the porous elastic layer 4*c* is smaller in thermal capacity than the nonporous elastic layer 4*b*. Because the pressure rollers in the preceding embodiments have two elastic layers which are different in characteristic, not only can they prevent the out-of-sheet-path portions from excessively increasing in temperature, but also, can reduce a fixing device in the length of time it takes for a fixing device to startup.

By the way, in the above-described embodiments of the present invention, the nonporous elastic layer 4*b* is separately formed from the porous elastic layer 4*c*. However, these embodiments are not intended to limit the present invention in scope. That is, the nonporous elastic layer 4*b* and porous elastic layer 4*c* may be formed together as an elastic layer which has two elastic sublayers which are different in characteristic. Further, the nonporous elastic layer 4*b* and porous elastic layer 4*c* were described as the elastic sublayers of the elastic layer, which are different in characteristic. However, it is not mandatory that a pressure roller has an elastic layer having two elastic sublayers which are different in characteristic. That is, the pressure roller 4 may be structured so that the nonporous elastic layer 4*b* and porous elastic layer 4*c* have their own sublayers which are different in characteristic. In a case where a pressure roller is structured so that the nonporous elastic layer 4*b* or porous elastic layer 4*c* is provided with multiple sublayers, the elastic layers 4*b* and 4*c* can be adjusted in characteristic according to the combination of their sublayers.

Further, in the above-described embodiments, the pressure applying rotational member was the pressure roller 4. However, these embodiments are not intended to limit the present invention in scope. For example, the present invention is also compatible with an endless pressure belt formed of a thin layer of heat resistant resin such as polyamide, poly amide-imide, polyether-ether-ketone (PEEK), or a thin layer of a metallic substance (substrate) such as stainless steel (SUS) and nickel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 254131/2013 filed Dec. 9, 2013, which is hereby incorporated by reference.

What is claimed is:

1. A pressing roller comprising:

a cylindrical core metal;

a first rubber layer of non-porous material provided on the core metal; and a second rubber layer of porous material provided on the first rubber layer, wherein the second rubber layer includes a thermo-conductive filler dispersed therein such that a thermal conductivity of the second rubber layer in a longitudinal direction is higher than a thermal conductivity thereof in a thickness direction, and wherein the first rubber layer includes a thermo-conductive filler dispersed therein such that a thermal conductivity of the first rubber layer in a thickness direction is higher than a thermal conductivity of the second rubber layer in the thickness direction of the second rubber layer.

2. The pressing roller according to claim 1, wherein the thermal conductivity of the second rubber layer in the longitudinal direction is not less than 6-times the thermal conductivity of the second rubber layer in the thickness direction.

3. The pressing roller according to claim 2, wherein the thermo-conductive filler in the second rubber layer is a whisker filler having a thermal conductivity of not less than 500 W/(m·k) in a longitudinal direction of the whisker filler.

4. The pressing roller according to claim 3, wherein the whisker filler is a needle-shaped filler that has an average diameter of 5-11 μm and an average length of 50-1000 μm.

5. The pressing roller according to claim 2, wherein the thermal conductivity of the first rubber layer in the thickness direction is not less than 0.5 W/(m·k).

6. The pressing roller according to claim 5, wherein the thermo-conductive filler in the second rubber layer is a whisker filler having a thermal conductivity of not less than 500 W/(m·k) in a longitudinal direction of the whisker filler.

7. The pressing roller according to claim 6, wherein the whisker filler is a needle-shaped filler that has an average diameter of 5-11 μm and an average length of 50-1000 μm.

8. The pressing roller according to claim 1, wherein the thermo-conductive filler of the second rubber layer is dispersed such that a thermal conductivity in a circumferential direction thereof, is higher than the thermal conductivity in the thickness direction.

9. The pressing roller according to claim 8, wherein the thermal conductivity of the second rubber layer in the circumferential direction is not less than 6-times the thermal conductivity of the second rubber layer in the thickness direction.

10. The pressing roller according to claim 1, wherein a sum of thicknesses of the first rubber layer and the second rubber layer is 2.0-10.0 mm, and a thickness of the second rubber layer is 0.3-5.0 mm.

11. An image heating apparatus comprising:

(i) a rotatable heating member configured to heat a toner image on a recording material by a nip; and (ii) a pressing rotatable member cooperative with the rotatable heating member to form the nip, the pressing rotatable member including:

(ii-i) a base;

(ii-ii) a first rubber layer of non-porous material provided on the base; and (ii-iii) a second rubber layer of porous material provided on the first rubber layer, wherein the second rubber layer includes a thermo-conductive filler dispersed therein such that a thermal conductivity of the second rubber layer in a longitudinal direction is higher than a thermal conductivity thereof in a thickness direction, and wherein the first rubber layer includes a thermo-conductive filler dispersed therein such that a thermal conductivity of the first rubber layer in a thickness direction is higher than a thermal conductivity of the second rubber layer in the thickness direction of the second rubber layer.

12. The apparatus according to claim 11, wherein the thermal conductivity of the second rubber layer in the longitudinal direction is not less than 6-times the thermal conductivity of the second rubber layer in the thickness direction.

13. The apparatus according to claim 12, wherein the thermo-conductive filler in the second rubber layer is a whisker filler having a thermal conductivity of not less than 500 W/(m·k) in a longitudinal direction of the whisker filler.

14. The apparatus according to claim 13, wherein the whisker filler is a needle-shaped filler that has an average diameter of 5-11 μm and an average length of 50-1000 μm.

15. The apparatus according to claim 12, wherein the thermal conductivity of the first rubber layer in the thickness direction is not less than 0.5 W/(m·k).

16. The apparatus according to claim 15, wherein the thermo-conductive filler in the second rubber layer is a whisker filler having a thermal conductivity of not less than 500 W/(m·k) in a longitudinal direction of the whisker filler.

17. The apparatus according to claim 16, wherein the whisker filler is a needle-shaped filler that has an average diameter of 5-11 μm and an average length of 50-1000 μm.

18. The apparatus according to claim 11, wherein the thermo-conductive filler of the second rubber layer is dispersed such that a thermal conductivity in a circumferential direction thereof, is higher than the thermal conductivity in the thickness direction.

19. The apparatus according to claim 18, wherein the thermal conductivity of the second rubber layer in the circumferential direction is not less than 6-times the thermal conductivity of the second rubber layer in the thickness direction.

20. The apparatus according to claim 11, wherein a sum of thicknesses of the first rubber layer and the second rubber layer is 2.0-10.0 mm, and a thickness of the second rubber layer is 0.3-5.0 mm.

* * * * *